US005451052A

United States Patent [19]

Behm et al.

[11] Patent Number: 5,451,052

[45] Date of Patent: Sep. 19, 1995

[54] SCRATCH-OFF GAME AND GAME PIECE THEREFOR

[75] Inventors: William F. Behm, Marietta; Terry D. Mangold; Howard D. Roath, both of Alpharetta, all of Ga.; Stephen Crocker, Redwood City, Calif.

[73] Assignee: Scientific Games, Inc., Marietta, Ga.

[21] Appl. No.: 302,114

[22] Filed: Sep. 7, 1994

[51] Int. Cl.[6] ..... A63F 3/06; B42D 15/00

[52] U.S. Cl. ..... 273/139; 273/138 R; 283/903; 283/901

[58] Field of Search ..... 273/138 R, 138 A, 139; 283/903, 901, 100–103

[56] References Cited

U.S. PATENT DOCUMENTS

| | | | |
|---|---|---|---|
| 4,466,614 | 8/1984 | Bachman et al. | 273/139 |
| 5,037,099 | 8/1991 | Burtch | 273/139 |
| 5,092,598 | 3/1992 | Kamille | 273/139 |
| 5,158,293 | 10/1992 | Mullins | 273/139 |
| 5,193,815 | 3/1993 | Pollard | 273/139 |

FOREIGN PATENT DOCUMENTS

| | | | |
|---|---|---|---|
| 598964 | 12/1978 | Switzerland | 273/139 |

OTHER PUBLICATIONS

Maine State Lottery Ticket, Instant Pick 4, 2 pages (p. 1, ticket before being scratched; p. 2, ticket after being scratched), Press date: May 31, 1994; Sale date Jun. 7, 1994.

*Primary Examiner*—Benjamin H. Layno
*Attorney, Agent, or Firm*—Needle & Rosenberg

[57] ABSTRACT

A game piece and a method of simulating a player selection lottery game using the game piece. The game piece is made from a substrate. The game piece has predetermined playing groups of digits and at least two matching groups of digits printed thereon. The game piece also has, for each matching group of digits, a predetermined prize indicia. These prize indicia represent prizes associated with each of the matching groups. Either the playing or matching groups (or preferably both) are covered with, for example, aluminum permeated latex. The player scratches off the latex from a playing and a matching group, and depending upon the relevant match type, compares the groups accordingly. The relevant match types include a potential exact order match to a selected playing group, an any order match to a selected playing group, a plurality match to a selected playing group, and a single digit match to a selected playing group. If the criteria of the match type are met, the game piece is redeemable for the prize indicated in the associated predetermined prize indicia. The predetermined prize indicia may also be covered with latex.

26 Claims, 2 Drawing Sheets

FRONT OF TICKET - 100% COVERED

FRONT OF TICKET - 100% UNCOVERED

SCRATCH-OFF GAME AND GAME PIECE THEREFOR

This patent document contains portions which constitute copyrighted subject matter. The owner of the copyright has no objection to the facsimile reproduction of this patent disclosure, as it appears in the Patent and Trademark Office patent files or records, but otherwise reserves all applicable copyright privileges.

FIELD OF THE INVENTION

The present invention relates to a game piece and a method of playing a scratch-off game. In particular, the present invention relates to a deterministic, scratch off type game piece for simulating a player selection lottery game and methods of using this game piece.

BACKGROUND OF THE INVENTION

In the 1970s, lottery games were introduced in which players could purchase tickets for which the results could instantly be determined. These games generally included a scratch-off ticket (or game piece) where a number of items were to be matched according to a predetermined winning scheme.

There are two kinds of scratch-off games, deterministic and probabilistic. An example of predetermined (or deterministic) play is a ticket having one or more covered playing areas which can be revealed by removing rub and reveal material, generally aluminum permeated latex. When the playing areas are uncovered, the information printed on the ticket completely determines whether the ticket is a winning ticket. When the tickets are printed, the sponsor predetermines the number of winners by controlling the number of winning tickets printed. The disadvantage of deterministic games is that most tickets are non-winning and, therefore, the player feels he or she has little or no control over the game.

On the other hand, an example of a probability game is a game piece having three sections, each having two covered playing areas where a winning symbol is present in only one of the playing areas in each section. To win, the winning symbols must be the only symbols revealed. The sponsor, therefore, depends upon probability distribution to control the prize allocation. Potentially, each ticket is a winner. The problem with probability games is that the game can often be "cracked" or a larger than expected number of people could be lucky. In either case, the sponsor could potentially lose money. Also, significant validation problems exist with probability games. For instance, in order to validate such tickets, the validator must know which boxes have been scratched off from a particular ticket. Probability game tickets are further subject to tampering in that a clever individual can remove the latex, discover the winning combination and, finally, replace the latex and redeem the ticket, all without the sponsor or validator ever suspecting such tampering.

A popular type of non-instant lottery game is where the player picks his or her own numbers. Such games are referred to as "player selection" games. The well-known pick 3, pick 4 and lotto jackpot games fall within this category. Pick 3 and pick 4 games require the player to choose three or four numbers, respectively, which are then matched in consecutive order to a winning number produced by the lottery operator. Other variations of these pick 3 and pick 4 games exist. The lotto jackpot game is played by picking 5 or 6 numbers ranging from 1 to about 40 or 50. The numbers may be selected at random by a computer or the player may choose his or her own numbers. No particular order of numbers is required to win. At a specified time, the lottery operator randomly chooses 5 or 6 numbers. Any player who has picked the identical numbers wins a share of the jackpot. The odds of winning a 6 number lotto game based upon numbers ranging from 1 to 50 are in excess of about 1 in 13 million.

The extremely low odds of winning 5 and 6 number lotto games leads many players to prefer the pick 3 and pick 4 variety of games. However, as they presently exist, these games are somewhat inconvenient in that the player does not instantly know whether he or she has won. Instead, the player must wait until the game sponsors choose the winning numbers. In addition, the player must then seek out the information about -winning numbers from either the television, point of sale, newspaper, or some other means. Usually, the lottery operator holds daily drawings for pick 3 and pick 4 player selection games.

Prior art deterministic scratch-off type game pieces are also known. One such game piece has a substrate and a single section where a four digit lottery number is printed. Also in that section, the player's four digit number is printed. Determination of whether the ticket is winning is made by examining a legend printed elsewhere on the substrate which indicates various prizes for different types of matches: 4 digits in exact order, 4 digits in any order, 1st and 2nd digits in exact order, 3rd and 4th digits in exact order, 1st digit only, 2nd digit only, 3rd digit only and 4th digit only. One problem with this type of game piece is that it is limited to only one playing group of digits and one matching group of digits, thereby decreasing the entertainment value of the game piece. Another problem is that there is only one matching group of digits, also decreasing the entertainment value of the game piece. Furthermore, the prize indicia are both fixed and are not associated with any particular matching group (as there is only one such group) thereby decreasing the versatility of the game piece and the player's enjoyment of the game play.

Therefore, there exists a need for a new type of instant lottery game wherein the preferable winning odds of pick 3 and pick 4 player selection games exist, yet which is fun to play as well as convenient to the player. It is highly desirable to provide a simulated player selection type game piece which is deterministic, has at least two matching groups of digits, and which provides the player with at least a feeling that he or she has some control over the game.

SUMMARY OF THE INVENTION

The present invention provides a novel game piece and methods for playing a simulated player selection lottery game similar to a pick 3 or pick 4 game, but provides further options for improved playability.

The present invention provides a game piece comprising a substrate, a plurality of predetermined printed indicia on the substrate representing "drawn" digits printed in at least one "playing group" consisting of a preselected number of drawn digits, a plurality of predetermined printed indicia on the substrate representing "matchable" digits printed in at least two "matching groups" consisting of a preselected number of matchable digits, a plurality of predetermined prize indicia on the substrate representing a plurality of prizes, wherein each of the prize indicia is associated with each of the at least two matching groups and means for removably covering the predetermined printed indicia representing at least one of each of the at least one playing groups and each of the at least two matching groups. A selected one of the matching groups represents a first match type selected from the group consisting of a potential exact order match to a selected playing group, an any order match to a selected playing group, a plurality match to a selected playing group, and a single digit match to a selected playing group.

Although at least two matching groups are necessary, the game is more playable if more matching groups are included. Furthermore, if the multiple matching groups are of different match types, the playability is also increased. Thus, the game piece can either have multiple matching groups of one match type, or it can have matching groups of two or more types. Finally, the game piece can have multiple matching groups under each of more than one differing match type.

The preselected number of drawn digits may differ from the preselected number of matchable digits. However, in a preferred embodiment, the preselected number of drawn digits equals the preselected number of matchable digits. For instance, the preselected number of drawn digits may be three. Then, the selected plurality match can be either a front pair or a back pair match.

In addition, all of the playing groups or all of the matching groups need not be covered by the means for covering. Either each of the playing groups or each of the matching groups must be covered. In a preferred embodiment, all of the playing and matching groups are initially covered. In addition, the predetermined prize indicia may be covered by a further covering means.

The present invention also provides a method of simulating a player selection lottery game. The first step is to provide the game piece described above. The player removes the means for removably covering the predetermined printed indicia representing a selected playing group. The player also removes the means for removably covering the predetermined printed indicia representing a selected matching group. The player then compares the uncovered selected matching group with the uncovered selected playing group. The game piece is redeemable for the prize indicated in the associated predetermined prize indicia if the selected matching group is of the first match type.

As noted above, the game piece contains multiple matching groups. Thus, the game piece may further comprise a second, third, fourth, etc. matching group consisting of a preselected number of matchable digits. These further groups may be of the same match type or of differing match types. However, if the game piece has only one match type, then there will be at least two matching groups for that type of match.

These methods may be practiced where the preselected number of drawn digits equals or differs from the preselected number of matchable digits. If they are equal, the preselected number of drawn digits may preferably be three. In such a case, the selected plurality match may be either a front pair or a back pair match.

DETAILED DESCRIPTION OF THE INVENTION

1: Game Piece

The game piece of the instant invention is useful for simulating a player selection lottery game, such as a pick 3 game. The terms used herein to refer to the groups of printed indicia are derived from the function in the conventional game that they are intended to simulate. In the conventional version of such a game, the player generally selects three digits or numbers which are then printed upon a game coupon by the lottery operator. At a preselected time and place, the lottery operator draws three digits at random. Depending upon the identity of those digits and the rules of the particular game being played, the player compares his or her "matchable" digits with the sponsor's "playing" digits. For a pick 3 game, the digits are typically integers which range from "0" to "9". Thus, the drawn numbers are a group of three digits, a "playing group." Likewise, the matchable numbers are also a group of three digits, a "matching group." The rules can provide for several ways to win, including exact order matching, any order matching, single digit matching and pair matching (all described elsewhere below).

Figure 1:
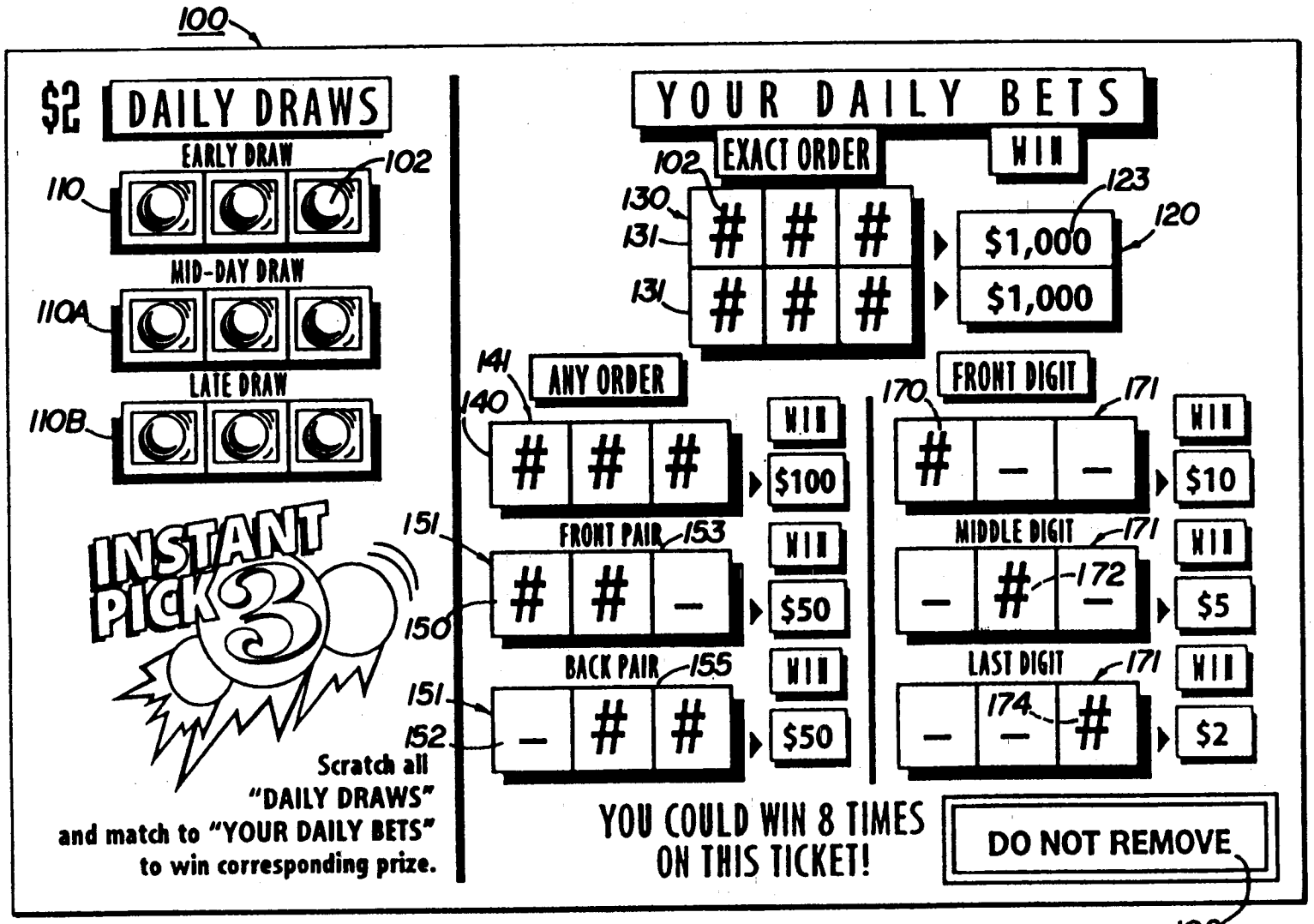
FIG. 1 is a top plan view of a game piece of the invention with means for covering in place.
Figure 2:
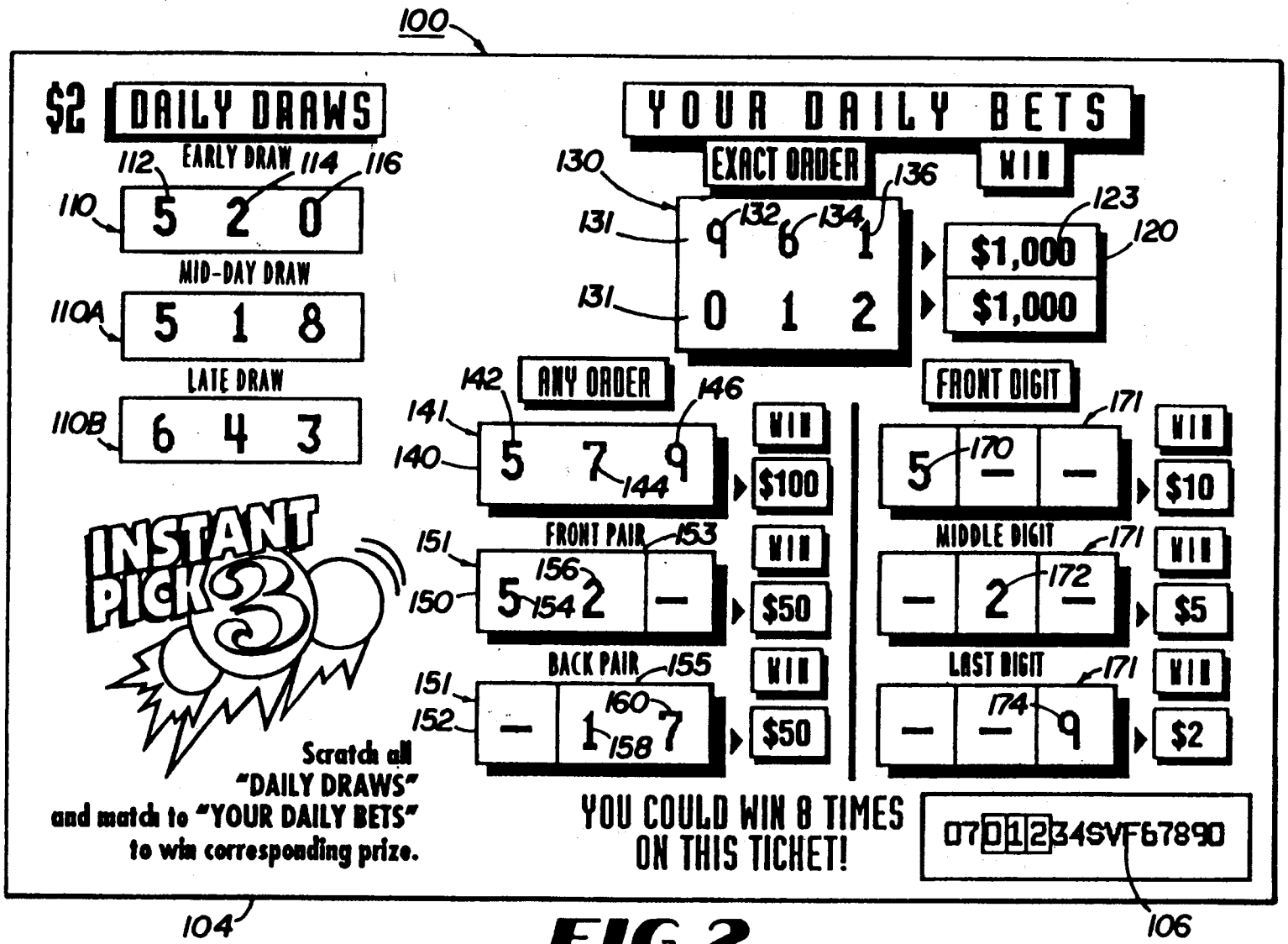
FIG. 2 is a top plan view of game piece of the invention with means for covering removed.

Referring now to FIGS. 1 and 2, a preferred embodiment of the present invention provides a game piece 100. The game piece 100 consists of several parts. First, there is the substrate 104. Suitable substrate materials include, but are not limited to, paper, plastic and aluminum foil laminated to paper stock. Upon the substrate 104 are printed a plurality of printed indicia of several different types. These printed indicia are predetermined (i.e., the sponsors of the game know the values of the indicia printed to be printed on each ticket) by computer or other automated or manual means, as discussed below. The printed indicia can, for example, represent a preselected number (three in the embodiment described herein) of drawn digits 112, 114 and 116. In a conventional player selection pick 3 lottery game, the lottery operator randomly draws three numbers at a specified time, such as every evening. Thus, the drawn digits of the present invention simulate the numbers randomly selected by the lottery operator of a conventional pick 3 player selection lottery game.

In FIG. 2, the digits 112, 114 and 116 are integers, each ranging from "0" to "9" on different game pieces. The three numbers, as a group, represent a "playing group" 110 of drawn digits. One skilled in the art would recognize that letters of the alphabet or any other unique symbols could be used instead of digits. The realism of the simulation is enhanced by the use of integral digits. One skilled in the art would also recognize that the number of digits could vary from 1 to 20, more preferably from 2 to 10 and most preferably from 3 to 6. The present embodiment, using three digits, is intended as an example and not a limitation upon the scope of the invention.

Tickets are printed using a computer-controlled inkjet imager for application of the variable game data/printed indicia. Printed indicia include the drawn digits, matchable digits and prize indicia, as described elsewhere herein. Ticket symbols and fonts are printed in black or colored ink on the front of the ticket and are sufficiently legible so as to be readily discernible to a person with normal vision under normal lighting conditions. In addition, the ink and substrate 104 must be chosen such that abrasion of the latex covering does not also abrade the covered printed indicia.

The game piece 100 of FIGS. 1 and 2 is printed with computer-controlled Scitex 3600 ink-jet imagers (Dayton, Ohio) which results in an image resolution of 240 dots per inch. All of the variable game data/printed indicia on the tickets are printed using these imagers. The imagers receive their instructions as to what data to print from a computer-readable magnetic tape which contains the data to be printed on each ticket, in accordance with the prize structure (e.g., Table 1 below) for the game. The data appearing on the imager tape is created by a computer program which shuffles the winning tickets among the supply of non-winning tickets in the game. Such shuffling algorithms are well known in the art. See, e.g., U.S. Pat. No. 4,398,708. One skilled in the art would recognize that the above is but one method of applying the printed indicia to scratch-off lottery tickets in accordance with a set prize structure and, therefore, is not intended as a limitation upon the scope of the present invention. Validation of the tickets is accomplished by methods well known in the art. By way of example only, FIGS. 1 and 2 depict a game piece 100 having validation indicia 106 printed thereon. This indicia is initially covered with latex or other means for covering 102. The validation indicia 106 contains sufficient information to reconstruct whether the game piece 100 is valid.

After the printed indicia are printed on the tickets, the aluminum permeated latex 102 is applied to cover the appropriate data. In the present game piece 100, latex is used to cover the digits of the playing groups 110–110B and matching groups 130, 140, 150 and 170.

As stated, playing groups 110 are printed in groups of three digits 112, 114 and 116. In the present embodiment, more than one playing group 110 is printed on the substrate 104. As shown in FIGS. 1 and 2, three playing groups 110, 110A and 110B, simulating the time of day, are printed on substrate 104. One skilled in the art would recognize that the exact number of playing groups 110 depends upon the desired size of the game piece 100, the odds of winning, and other considerations. For example, five playing groups 110 could be used to simulate the days of the week.

There are also a plurality of predetermined printed indicia on the substrate 104 representing matchable digits 132, 134 and 136. These indicia are printed in matching groups 130, 140, 150 and 170 consisting of a preselected number of matchable digits 132, 134 and 136. These groups simulate the player's selections in the conventional pick 3 game described above. One skilled in the art would recognize that any number of groups 130, 140, 150 and 170 may be present, limited only by the size of the game piece 100, game design and other considerations. At least two matching groups must be present, however.

Associated with each matching group 130, 140, 150 and 170 is a predetermined prize indicia 120 on the substrate 104. Each indicia 120 represents a prize. The prizes range from "free ticket" (not shown) to monetary amounts, e.g.,123, depending upon the odds of winning predetermined by the sponsor and the game design parameters, also determined by the sponsor. See Table 1 below. In the game piece 100 depicted in FIGS. 1 and 2, the predetermined prize indicia 120 are the same from ticket to ticket. One skilled in the art would recognize that the prize indicia 120 could vary from ticket to ticket.

Finally, placed over each of the printed indicia representing playing groups 110 and matching groups 130, 140, 150 and 170 is a means 102 for removably covering the predetermined printed indicia 118 and 119. Suitable 102 means include a thin layer of aluminum permeated latex, as is well known in the art. In addition, prize indicia 120 could be covered by a further covering means, namely, aluminum permeated latex (not shown). The player would need to remove this second means for covering in order to discover the prize he or she has won.

Each of the one or more matching groups 130, 140, 150 and 170 represents a specific type of potential match to any one of the one or more playing groups 110. In the preferred embodiment of FIGS. 1 and 2, there are four types of matches 131, 141, 151 and 171 contemplated. Whether a player wins is determined by the playing groups 110, the matching groups 130, 140, 150 and 170 and the type of match 131, 141, 151 and 171. In the preferred embodiment of FIGS. 1 and 2, the match type 131 is a potential exact order match to the selected playing group 110. An exact order match 131 means that for the digits 112, 114 and 116 in the playing group 110, the corresponding digits 132, 134 and 136 in matching group 130 are sequentially identical. Thus, if the playing group 110 is {1,2,3} and the matching group 130 is {1,2,3}, the criteria for the first match type 131 would be met. However, if the matching group 130 was {3,2,1} instead, no exact order match 131 would occur.

The next match type depicted in FIGS. 1 and 2 is an any order match 141 to a selected playing group 110. This case is broader than the exact order match 131. All of the matchable digits 142, 144 and 146 must still match. However, a playing group 110 of {1,2,3} would match a matching group 140 of {3,2,1} because each and every digit 112, 114 and 116 in the playing group 110 is accounted for as a digit 142, 144 or 146 in the matching group 140. However, a playing group 110 of {4,2,1} would not match a matching group 140 of {3,2,1} because the playing group 110 does not include a "3".

In FIGS. 1 and 2, the third match type 151 depicted is a plurality match to a selected playing group 110. As this embodiment uses only three digits, there are two possible third match types 151. The two types for groups of three digits are "front pair" 153 and "back pair" 155. For example, if the playing group 110 is {1,2,4} and the matching group 150 is {1,2,3}, then a front pair 153 type of plurality match 151 would occur because the "front pair", i.e. the first and second digits, 154 and 156, are both {1,2}. On the other hand, if the numbers described on a ticket in a playing group 110 are {1,2,3} and the matching groups, 150 and 152, are {-,4,3} or {1,4,-}, then no front or rear pair match would occur, even though two of the digits 154 and 160 are the same. This is because the front pair 153 and rear pair 155 plurality matches 151 require that the pairs be comprised of consecutive digits.

Finally, FIGS. 1 and 2 show a fourth match type, a single digit match 171 to a selected playing group 110. In this match type 171, a match occurs if any particular digit 170, 172 or 174 of the matching group 170 corresponds in value and position to that of the relevant digit 112, 114 or 116 of the playing group 110. Thus, if the preselected number of digits is three, then the playing group 110 {1,5,9} would match the matching group 172 {-,5,-} because the second digits in both groups are identical. However, the playing group 110 {1,5,9} would not match the matching groups 170, 172 or 174 {9,1,5}, because, although the values are identical for all three digits, the positions are not. To be a single digit match 171, the positions must be the same for the matching digits.

One skilled in the art would readily recognize that other match types (e.g., first and last digits) are possible and are included within the scope of the present invention.

The embodiment shown in FIGS. 1 and 2 depicts a game piece 100 which contains multiple matching groups 130, 140, 150 and 170. These matching groups each represent alternate match types 131, 141, 151 and 171 selected from the types described above. In preferred embodiments, the match types 131, 141, 151 and 171 differ from one another. One skilled in the art would recognize that a game piece 100 could be made which contained only one or two matching types or, potentially, ten different matching types. In addition, the number of matching groups listed for each type of match can vary depending upon the size of the game piece 100 and other game design parameters.

In the embodiment shown in FIGS. 1 and 2, the preselected number of drawn digits equals the preselected number of matchable digits. One skilled in the art would recognize that the preselected number of drawn digits may differ from the preselected number of matchable digits (not shown).

The embodiment shown in FIGS. 1 and 2 depicts a game piece 100 where the preselected number of drawn digits is three. One skilled in the art would recognize that other numbers of drawn digits, e.g. four (not shown), would also be covered by this invention with minor adjustments.

2. Method of Use

The preferred method of simulating a player selection lottery game consists of the steps of first providing a game piece 100 as described above. Then, the player removes the means 102 for removably covering the predetermined printed indicia representing a selected playing group 110–110B. If that means 102 is latex, the user simply scratches the latex off with, for example, the edge of a coin. This removal displays the playing group 110 of digits. In a similar manner, the player removes the means 102 for removably covering the predetermined printed indicia representing a selected matching group 130, 140, 150 and 170. Once completed, the player then compares the uncovered selected matching group 130, 140, 150 and 170 with the uncovered selected playing group 110–110B. The game piece 100 is redeemable for the prize indicated in the associated predetermined prize indicia 120 if the selected matching group 130, 140, 150 or 170 is of the first match type. In an alternate embodiment, the prize indicia are covered by a second covering means (not shown). In that case, the second covering means would have to be removed in order to determine the identity of the prize to be awarded.

For game pieces 100 with multiple match types, as depicted in FIGS. 1 and 2, the method includes the steps of removing any means 102 for removably covering the predetermined printed indicia representing the selected second (third, fourth, etc.) matching group 130, 140, 150 or 170 and comparing the uncovered selected matching group 130, 140, 150 or 170 with the uncovered selected playing group 110. In these further embodiments, the game piece 100 is redeemable for the prize indicated in the associated predetermined prize 120 indicia if the selected matching group 130, 140, 150 or 170 is of the appropriate match type.

This method may be practiced upon a game piece having multiple differing match types as described in detail above.

In a preferred embodiment, the digits discussed above are generated under computer control in such a way that each ticket appears to contain random digits, yet the sponsor of the lottery has control over the exact number of winning tickets and the total amount prizes to be awarded. An example of a distribution for the game piece 100 of FIGS. 1 and 2 is shown in Table 1.

TABLE 1

Prize Structure for Pick 3 Game Piece
10,080,000 tickets* $2 = $20,160,000 revenue. Prize fund is 60.01% of revenue or $12,097,153.

| Match | Win | Odds of 1 in: | Winners in 200 (book) | Winners in 120,000 (pool) | Winners in 84 pools | Prize Cost | % of Prize Fund |
|---|---|---|---|---|---|---|---|
| $2 | $2 | 11.11 | 18.00 | 10,800 | 907,200 | $1,814,400 | 15.00% |
| $2 × 2 | $4 | 25.00 | 8.00 | 4,800 | 403,200 | $1,612,800 | 13.33% |
| $5 | $5 | 33.33 | 6.00 | 3,600 | 302,400 | $1,512,000 | 12.50% |
| $5 × 2 | $10 | 100.00 | 2.00 | 1,200 | 100,800 | $1,008,000 | 8.33% |
| $10 | $10 | 400.00 | 0.50 | 300 | 25,200 | $252,000 | 2.08% |
| $5 + $10 | $15 | 100.00 | 2.00 | 1,200 | 100,800 | $1,512,000 | 12.50% |
| $10 × 2 | $20 | 200.00 | 1.00 | 600 | 50,400 | $1,008,000 | 8.33% |
| $5 + $10 × 2 | $25 | 200.00 | 1.00 | 600 | 50,400 | $1,260,000 | 10.42% |
| $5 × 2 + $10 × 2 | $30 | 400.00 | 0.50 | 300 | 25,200 | $756,000 | 6.25% |
| $50 | $50 | 2400.00 | — | 50 | 4,200 | $210,000 | 1.74% |
| $10 + $50 | $60 | 3000.00 | — | 40 | 3,360 | $201,600 | 1.67% |
| $10 × 2 +$50 | $70 | 3428.57 | — | 35 | 2,940 | $205,800 | 1.70% |
| $5 + $10 × 2 + $50 | $75 | 4,800.00 | — | 25 | 2,100 | $157,500 | 1.30% |
| $50 × 2 | $100 | 6,000.00 | — | 20 | 1,680 | $168,000 | 1.39% |
| $100 | $100 | 12,000.00 | — | 10 | 840 | $84,000 | 0.69% |
| $5 + $10 × 2 +$100 | $125 | 24,000.00 | — | 5 | 420 | $52,500 | 0.43% |
| $50 + $100 | $150 | 30,000.00 | — | 4 | 336 | $50,400 | 0.42% |
| $100 × 2 | $200 | 120,000.00 | — | 1 | 84 | $16,800 | 0.14% |
| $1,000 | $1,000 | 240,000.00 | — | (1 in 2) | 42 | $42,000 | 0.35% |
| $1,000 × 2 | $2,000 | 240,000.00 | — | (1 in 2) | 42 | $84,000 | 0.69% |
| $100 × 2 + $1,000 × 2 | $2,200 | 775,394.62 | — | — | 13 | $28,600 | 0.24% |
| $2 + $5 + $10 + $50 × 2 + $100 + $1,000 × 2 | $2,217 | 1,120,000.00 | — | — | 9 | $19,953 | 0.16% |
| $50 × 4 + $100 × 2 + $1,000 × 2 | $2,400 | 592,941.18 | — | — | 17 | $40,800 | 0.34% |

TABLE 1-continued

Prize Structure for Pick 3 Game Piece
10,080,000 tickets* $2 = $20,160,000 revenue. Prize fund is 60.01% of revenue or $12,097,153.

| Match | Win | Odds of 1 in: | Winners in 200 (book) | Winners in 120,000 (pool) | Winners in 84 pools | Prize Cost | % of Prize Fund |
|---|---|---|---|---|---|---|---|
| Total | | 5.09 | 39.00 | 23,590 | 1,981,683 | $12,097,153 | 100.00% |

As can be seen from this distribution, the prize pool is heavily weighted in the $5 to $30 range. The odds of winning such prizes are more reasonable than would be expected in a pick 3 player selection lottery game, where prize amounts must be tied to a probabilistic curve. Here, the sponsor has complete control over the exact odds and payout amount for the entire run of the game. One skilled in the art would recognize that the above prize structure is by way of example only, and should not be read as a limitation upon the invention.

The above embodiments are given as illustrative examples and are not intended to impose any limitations on the invention.

What is claimed is:

1. A game piece, comprising:

a) a substrate;

b) a plurality of predetermined printed indicia on the substrate representing drawn digits printed in at least one playing group consisting of a preselected number of drawn digits;

c) a plurality of predetermined printed indicia on the substrate representing matchable digits printed in at least two matching groups each consisting of a preselected number of matchable digits;

d) a plurality of predetermined prize indicia on the substrate representing a plurality of prizes, wherein each of the prize indicia is associated with each of the at least two matching groups; and e) means for removably covering the predetermined printed indicia representing at least one of:

i) each of the at least one playing groups; and ii) each of the at least two matching groups, and wherein a selected one of the matching groups represents a first match type selected from the group consisting of: a potential exact order match to a selected playing group, an any order match to a selected playing group, a plurality match to a selected playing group, and a single digit match to a selected playing group.

2. The game piece of claim 1, further comprising at least one second matching group consisting of a preselected number of matchable digits, wherein the second matching group represents a second match type selected from the group consisting of: a potential exact order match to a selected playing group, an any order match to a selected playing group, a plurality match to a selected playing group, and a single digit match to a selected playing group, and wherein the second match type differs from the first match type.

3. The game piece of claim 2, further comprising at least one third matching group consisting of a preselected number of matchable digits, wherein the third matching group represents a third match type selected from the group consisting of: a potential exact order match to a selected playing group, an any order match to a selected playing group, a plurality match to a selected playing group, and a single digit match to a selected playing group, and wherein the third match type differs from the first and second match types.

4. The game piece of claim 3, further comprising at least one fourth matching group consisting of a preselected number of matchable digits, wherein the fourth matching group represents a fourth match type selected from the group consisting of: a potential exact order match to a selected playing group, an any order match to a selected playing group, a plurality match to a selected playing group, and a single digit match to a selected playing group, and wherein the fourth match type differs from the first, second and third match types.

5. The game piece of claim 1, wherein the preselected number of drawn digits equals the preselected number of matchable digits.

6. The game piece of claim 1, wherein the preselected number of drawn digits differs from the preselected number of matchable digits.

7. The game piece of claim 5, wherein the preselected number of drawn digits is three.

8. The game piece of claim 7, wherein the selected plurality match comprises a front pair match.

9. The game piece of claim 7, wherein the selected plurality match comprises a back pair match.

10. The game piece of claim 1, wherein the means for removably covering the predetermined printed indicia covers the predetermined printed indicia representing each of the at least one playing groups.

11. The game piece of claim 1, wherein the means for removably covering the predetermined printed indicia covers the predetermined printed indicia representing each of the at least two matching groups.

12. The game piece of claim 1, wherein the means for removably covering the predetermined printed indicia covers the predetermined printed indicia representing:

a) each of the at least one playing groups; and b) each of the at least two matching groups.

13. The game piece of claim 1, further comprising second means for removably covering the predetermined prize indicia.

14. A method of simulating a player selection lottery game, comprising the steps of:

a) providing a game piece comprising i) a substrate;

ii) a plurality of predetermined printed indicia on the substrate representing drawn digits printed in at least one playing group consisting of a preselected number of drawn digits;

iii) a plurality of predetermined printed indicia on the substrate representing matchable digits printed in at least two matching groups each consisting of a preselected number of matchable digits;

iv) a plurality of predetermined prize indicia on the substrate representing a plurality of prizes, wherein each of the prize indicia is associated with each of the at least two matching groups; and v) means for removably covering the predetermined printed indicia representing at least one of:

1) each of the at least one playing groups; and 2) each of the at least two matching groups, and wherein a selected one of the matching groups represents a first match type selected from the group consisting of: a potential exact order match to a selected playing group, an any order match to a selected playing group, a plurality match to a selected playing group, and a single digit match to a selected playing group;

b) removing the means for removably covering the predetermined printed indicia representing a selected playing group;

c) removing the means for removably covering the predetermined printed indicia representing a selected matching group; and d) comparing the uncovered selected matching group with the uncovered selected playing group, whereby the game piece is redeemable for the prize indicated in the associated predetermined prize indicia if the selected matching group is of the first match type.

15. The method claim 14, wherein the game piece further comprises at least one second matching group consisting of a preselected number of matchable digits, wherein the second matching group represents a second match type selected from the group consisting of: a potential exact order match to a selected playing group, an any order match to a selected playing group, a plurality match to a selected playing group, and a single digit match to a selected playing group, and wherein the second match type differs from the first match type, and further comprising the steps of:

a) removing the means for removably covering the predetermined printed indicia representing the selected second matching group; and b) comparing the uncovered second matching group with the uncovered selected playing group, whereby the game piece is redeemable for the prize indicated in the associated predetermined prize indicia if the selected second matching group is of the second match type.

16. The method claim 15, wherein the game piece further comprises at least one third matching group consisting of a preselected number of matchable digits, wherein the third matching group represents a third match type selected from the group consisting of: a potential exact order match to a selected playing group, an any order match to a selected playing group, a plurality match to a selected playing group, and a single digit match to a selected playing group, and wherein the third match type differs from the first and second match types, and further comprising the steps of:

a) removing the means removably covering the predetermined printed indicia representing the selected third matching group; and b) comparing the uncovered selected third matching group with the uncovered selected playing group, whereby the game piece is redeemable for the prize indicated in the associated predetermined prize indicia if the selected third matching group is of the third match type.

17. The method claim 16, wherein the game piece further comprises at least one fourth matching group consisting of a preselected number of matchable digits, wherein the fourth matching group represents a fourth match type selected from the group consisting of: a potential exact order match to a selected playing group, an any order match to a selected playing group, a plurality match to a selected playing group, and a single digit match to a selected playing group, and wherein the fourth match type differs from the first, second and third match types, and further comprising the steps of:

a) removing the means removably covering the predetermined printed indicia representing the selected fourth matching group; and b) comparing the uncovered selected fourth matching group with the uncovered selected playing group, whereby the game piece is redeemable for the prize indicated in the associated predetermined prize indicia if the selected fourth matching group is of the fourth match type.

18. The method of claim 14, wherein the preselected number of drawn digits equals the preselected number of matchable digits.

19. The method of claim 18, wherein the preselected number of drawn digits is three.

20. The method of claim 19, wherein the selected plurality match comprises a front pair match.

21. The method of claim 19, wherein the selected plurality match comprises a back pair match.

22. The method of claim 14, wherein the preselected number of drawn digits differs from the preselected number of matchable digits.

23. The method of claim 14, wherein the means for removably covering the predetermined printed indicia covers the predetermined printed indicia representing each of the at least one playing groups.

24. The method of claim 14, wherein the means for removably covering the predetermined printed indicia covers the predetermined printed indicia representing each of the at least two matching groups.

25. The method of claim 14, wherein the means for removably covering the predetermined printed indicia covers the predetermined printed indicia representing:

a) each of the at least one playing groups; and b) each of the at least two matching groups.

26. The method of claim 14, wherein the game piece further comprises second means for removably covering the predetermined prize indicia and further comprising the step of, before the comparing step, removing the second means for removably covering the predetermined prize indicia.

* * * * *